US008650905B2

(12) United States Patent
De Larminat et al.

(10) Patent No.: US 8,650,905 B2
(45) Date of Patent: Feb. 18, 2014

(54) FALLING FILM EVAPORATOR

(75) Inventors: Paul De Larminat, Nantes (FR); Luc Le Cointe, Nantes (FR); Satheesh Kulankara, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 537 days.

(21) Appl. No.: 13/009,406

(22) Filed: Jan. 19, 2011

(65) Prior Publication Data

US 2011/0120181 A1 May 26, 2011

Related U.S. Application Data

(62) Division of application No. 11/962,605, filed on Dec. 21, 2007, now abandoned.

(60) Provisional application No. 60/890,473, filed on Feb. 17, 2007, provisional application No. 60/871,303, filed on Dec. 21, 2006.

(51) Int. Cl.
*F25B 39/02* (2006.01)

(52) U.S. Cl.
USPC ..... 62/515; 62/525; 62/527

(58) Field of Classification Search
USPC ..... 62/515, 498, 471, 525, 527; 165/115, 165/159, 160
See application file for complete search history.

(56) References Cited

U.S. PATENT DOCUMENTS

| | | | |
|---|---|---|---|
| 939,143 | A | 11/1909 | Lillie |
| 2,012,183 | A | 8/1935 | Carrier |
| 2,059,725 | A | 11/1936 | Carrier |
| 2,091,757 | A | 8/1937 | Nanny |
| 2,384,413 | A | 9/1945 | Zwickl |
| 2,411,097 | A | 11/1946 | Kopp |
| 2,492,725 | A | 12/1949 | Ashley |
| 3,004,396 | A | 10/1961 | Endress et al. |
| 3,132,064 | A | 5/1964 | Scheffers |
| 3,180,408 | A | 4/1965 | Grotz, Jr. et al. |
| 3,191,396 | A | 6/1965 | Ruddock |
| 3,197,387 | A | 7/1965 | Lawrance |
| 3,213,935 | A | 10/1965 | Reid, Jr. |
| 3,240,265 | A | 3/1966 | Weller |
| 3,259,181 | A | 7/1966 | Ashley et al. |
| 3,267,693 | A | 8/1966 | Richardson et al. |

(Continued)

FOREIGN PATENT DOCUMENTS

| | | | |
|---|---|---|---|
| EP | 1030154 | A2 | 8/2000 |
| GB | 2161256 | A | 1/1986 |

(Continued)

OTHER PUBLICATIONS

Witt, "Spray Evaporator—Assembly and Instructions for the BVKF Models", Nov. 1, 1998, pp. 1-11, Figures p. 2.

*Primary Examiner* — Mohammad M Ali

(74) *Attorney, Agent, or Firm* — McNees Wallace & Nurick LLC

(57) ABSTRACT

An evaporator for use in a refrigeration system includes a shell and a tube bundle, the tube bundle having a plurality of tubes extending substantially horizontally in the shell. A hood is disposed over and laterally surrounds substantially all of the plurality of tubes of the tube bundle. A distributor is positioned between the hood and the tube bundle. The hood is asymmetrically disposed within the evaporator.

3 Claims, 6 Drawing Sheets

(56) References Cited

U.S. PATENT DOCUMENTS

| | | | | |
|---|---|---|---|---|
| 3,276,217 | A | 10/1966 | Bourne et al. | |
| 3,326,280 | A | 6/1967 | Bosquain et al. | |
| 3,351,119 | A | 11/1967 | Rosenblad | |
| 3,412,569 | A | 11/1968 | Arledge, Jr. | |
| 3,412,778 | A | 11/1968 | Witt et al. | |
| 3,635,040 | A | 1/1972 | Morris, Jr. | |
| 3,735,811 | A | 5/1973 | Moser et al. | |
| 3,775,993 | A | 12/1973 | Murphy | |
| 3,831,390 | A | 8/1974 | Hopkins | |
| 3,849,232 | A | 11/1974 | Kessler et al. | |
| 4,094,734 | A * | 6/1978 | Henderson | 159/13.2 |
| 4,154,642 | A | 5/1979 | Mattern et al. | |
| 4,158,295 | A | 6/1979 | Sibley | |
| 4,437,322 | A | 3/1984 | Ertinger | |
| 4,511,432 | A | 4/1985 | Sephton | |
| 4,520,866 | A | 6/1985 | Nakajima et al. | |
| 4,568,022 | A | 2/1986 | Scrivnor | |
| 4,706,741 | A | 11/1987 | Bolmstedt et al. | |
| 4,918,944 | A | 4/1990 | Takahashi et al. | |
| 4,944,839 | A | 7/1990 | Rosenblad | |
| 4,972,903 | A | 11/1990 | Kwok | |
| 4,977,861 | A | 12/1990 | Charbonnel et al. | |
| 5,044,427 | A | 9/1991 | Love et al. | |
| 5,086,621 | A | 2/1992 | Starner et al. | |
| 5,246,541 | A | 9/1993 | Ryham | |
| 5,419,155 | A | 5/1995 | Boehde et al. | |
| 5,461,883 | A | 10/1995 | Terasaki | |
| 5,481,887 | A | 1/1996 | Terasaki | |
| 5,561,987 | A | 10/1996 | Hartfield et al. | |
| 5,575,889 | A | 11/1996 | Rosenblad | |
| 5,588,596 | A | 12/1996 | Hartfield et al. | |
| 5,624,531 | A * | 4/1997 | Knuutila et al. | 159/13.3 |
| 5,638,691 | A | 6/1997 | Hartfield et al. | |
| 5,645,124 | A | 7/1997 | Hartfield et al. | |
| 5,791,404 | A | 8/1998 | Bailey et al. | |
| 5,809,794 | A | 9/1998 | Sibik et al. | |
| 5,839,294 | A | 11/1998 | Chiang et al. | |
| 5,849,148 | A | 12/1998 | Walker | |
| 5,868,805 | A * | 2/1999 | Nilsson | 48/198.3 |
| 5,922,903 | A | 7/1999 | Pujado | |
| 5,931,020 | A | 8/1999 | Nakamura | |
| 6,035,651 | A | 3/2000 | Carey | |
| 6,089,312 | A | 7/2000 | Biar et al. | |
| 6,127,571 | A | 10/2000 | Mulvaney, III | |
| 6,167,713 | B1 | 1/2001 | Hartfield et al. | |
| 6,170,286 | B1 | 1/2001 | Keuper | |
| 6,233,967 | B1 | 5/2001 | Seewald et al. | |
| 6,253,571 | B1 | 7/2001 | Fujii et al. | |
| 6,293,112 | B1 | 9/2001 | Moeykens et al. | |
| 6,341,492 | B1 | 1/2002 | Carey | |
| 6,357,239 | B2 | 3/2002 | Carey | |
| 6,357,254 | B1 | 3/2002 | Xia | |
| 6,516,627 | B2 | 2/2003 | Ring et al. | |
| 6,532,763 | B1 | 3/2003 | Gupte | |
| 6,596,244 | B1 | 7/2003 | Pujado | |
| 6,606,882 | B1 | 8/2003 | Gupte | |
| 6,695,043 | B1 | 2/2004 | Wagner et al. | |
| 6,742,347 | B1 | 6/2004 | Kolk et al. | |
| 6,748,763 | B2 | 6/2004 | Schweigert et al. | |
| 6,749,817 | B1 | 6/2004 | Mulvaney, III | |
| 6,830,099 | B2 | 12/2004 | Moeykens | |
| 6,830,654 | B1 | 12/2004 | Salmisuo | |
| 6,868,695 | B1 | 3/2005 | Dingel et al. | |
| 2002/0007639 | A1 | 1/2002 | Carey | |
| 2002/0137874 | A1 | 9/2002 | Hucks et al. | |
| 2002/0162352 | A1 | 11/2002 | Ring et al. | |
| 2003/0230105 | A1 | 12/2003 | Lee | |
| 2004/0112573 | A1 | 6/2004 | Moeykens | |
| 2004/0245084 | A1 | 12/2004 | Bethge | |
| 2006/0080998 | A1 | 4/2006 | De Larminat et al. | |

FOREIGN PATENT DOCUMENTS

| | | | |
|---|---|---|---|
| JP | S52136449 | A | 11/1977 |
| JP | 56-155666 | A | 12/1981 |
| JP | 61-192177 | U | 11/1986 |
| JP | 08-233407 | A | 9/1996 |
| JP | 11-051593 | A | 2/1999 |
| JP | 2008516187 | A | 5/2008 |
| WO | 2006/044448 | A2 | 4/2006 |

* cited by examiner

FALLING FILM EVAPORATOR

CROSS REFERENCE TO RELATED PATENT APPLICATIONS

This application is a divisional of U.S. Non-Provisional application Ser. No. 11/962,605, filed Dec. 21, 2007, which claims the benefit of U.S. Provisional Application Nos. 60/871,303 and 60/890,473, filed Dec. 21, 2006 and Feb. 17, 2007, respectively, and both of which are hereby incorporated by reference.

BACKGROUND

The present application relates generally to falling film and hybrid falling film evaporator systems in refrigeration, air conditioning and chilled water systems or process systems.

Certain process systems, as well as refrigeration, air conditioning and chilled water systems, include an evaporator to effect a transfer of thermal energy between refrigerant of the system and another fluid to be cooled. One type of evaporator includes a shell with a plurality of tubes forming a tube bundle through which the fluid to be cooled is circulated. The refrigerant is brought into contact with the outer or exterior surfaces of the tube bundle inside the shell, resulting in a thermal energy transfer between the fluid to be cooled and the refrigerant. In a conventional evaporator, the refrigerant is heated and converted to a vapor state, which is then returned to a compressor where the vapor is compressed, to begin another refrigerant cycle. The cooled fluid is circulated to a plurality of heat exchangers located throughout the building. Warmer air is passed over the heat exchangers where the cooled fluid is being warmed, while cooling the air for the building returned to the evaporator to repeat the process.

For example, some types of evaporators with refrigerant boiling outside the tubes include flooded evaporators, falling film evaporators and hybrid falling film evaporators. In conventional flooded evaporators, the shell is partially filled with a pool of boiling liquid refrigerant in which the tube bundle is immersed.

In a conventional falling film evaporator, a dispenser deposits, such as by spraying, an amount of liquid refrigerant onto the surfaces of the tubes of the tube bundle from a position above the tube bundle, forming a layer (or film) of liquid refrigerant on the tube surface. The refrigerant in a liquid or two-phase liquid and vapor state contacts the upper tube surfaces of the tube bundle, and by force of gravity, falls vertically onto the tube surfaces of lower disposed tubes.

A conventional hybrid falling film evaporator incorporates the attributes of a falling film evaporator and a flooded evaporator by immersing a lesser proportion of the tubes of the tube bundle than the flooded evaporator while still spraying fluid on the upper tubes, similar to a falling film evaporator.

One challenge to the efficient operation of the falling film and hybrid falling film evaporators is that a portion of the fluid vaporizes and significantly expands in volume. The vaporized fluid expands in all directions, causing cross flow, or travel by the vaporized fluid in a direction that is transverse, or at least partially transverse to the vertical flow direction of the liquid fluid under the effect of gravity. Cross flow results in insufficient wetting of tubes of the tube bundle, significantly reducing heat transfer with the fluid to be cooled flowing inside those tubes in the tube bundle.

Another challenge is the compressor, which receives its supply of vaporized fluid from an outlet typically formed in the upper portion of the evaporator, can be damaged if the vaporized fluid contains entrained liquid droplets. Components must be implemented to provide separation between the vapor and liquid droplets. However, these components add to the complexity and cost of the system, and may also result in an undesired pressure drop prior to the vapor refrigerant reaching the compressor.

What are needed are falling film and hybrid falling film evaporators that substantially prevent cross flow caused by expanding vaporizing fluid and which also require less space than a flooded evaporator for liquid droplet separation than a conventional flooded or existing designs of flooded film or hybrid evaporators.

Intended advantages of the disclosed systems and/or methods satisfy one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

The present application relates to a refrigeration system including a compressor, a condenser, an expansion device and an evaporator connected in a closed refrigerant loop. The evaporator includes a shell having an upper portion and a lower portion and a tube bundle, the tube bundle having a plurality of tubes extending substantially horizontally in the shell. A hood is disposed over the tube bundle, the hood having a closed end and an open end opposite the closed end, the closed end being disposed above the tube bundle adjacent the upper portion of the shell. The hood further has opposed substantially parallel walls extending from the closed portion toward the open portion of the shell. A refrigerant distributor is disposed below the hood and above the tube bundle, the refrigerant distributor being configured to deposit liquid refrigerant or liquid and vapor refrigerant onto the tube bundle. The substantially parallel walls of the hood substantially prevent cross flow of the refrigerant between the plurality of tubes of the tube bundle. A flow distributor is disposed adjacent the open end between the hood and the shell. The flow distributor modifies the refrigerant flow between the hood and the shell to provide a more uniform refrigerant flow distribution.

The present application further relates to a falling film evaporator for use in a refrigeration system including a shell having an upper portion and a lower portion. A tube bundle has a plurality of tubes extending substantially horizontally in the shell. A hood is disposed over the tube bundle, the hood having a closed end and an open end opposite the closed end, the closed end being disposed above the tube bundle adjacent the upper portion of the shell. The hood further has opposed substantially parallel walls extending from the closed portion toward the open portion of the shell. A refrigerant distributor is disposed below the hood and above the tube bundle. The refrigerant distributor is configured to deposit liquid refrigerant or liquid and vapor refrigerant onto the tube bundle. The substantially parallel walls of the hood substantially prevent cross flow of the refrigerant between the plurality of tubes of the tube bundle. A flow distributor is disposed adjacent the open end between the hood and the shell. The flow distributor modifies the refrigerant flow between the hood and the shell to provide a more uniform refrigerant flow distribution.

The present application allows that the fluid distributor receives refrigerant at medium or high pressure, i.e., close to condensing pressure, and can be a two-phase liquid refrigerant and vapor refrigerant. Under these conditions, the refrigerant mist and droplets generated are contained below the hood and coalesced onto the tubes, as well as the roof and walls of the hood, to prevent the refrigerant mist and droplets from becoming entrained into the suction line. In addition, a flow distributor reduces gas velocity exiting the hood by providing a more uniform flow distribution. This improved flow distribution helps to further reduce droplet entrainment in the refrigerant mist that could reach the suction line.

The present application still further relates to a hybrid falling film evaporator for use in a refrigeration system including a shell having an upper portion and a lower portion. A lower tube bundle is in fluid communication with an upper tube bundle, the lower and upper tube bundles each having a plurality of tubes extending substantially horizontally in the shell, the lower tube bundle being at least partially submerged by refrigerant in the lower portion of the shell. A hood is disposed over the upper tube bundle, the hood having a closed end and an open end opposite the closed end, the closed end being adjacent the upper portion of the shell above the upper tube bundle. The hood further has opposed substantially parallel walls extending from the closed end toward the open end adjacent the lower portion of the shell. A refrigerant distributor is disposed above the upper tube bundle, the refrigerant distributor depositing refrigerant onto the upper tube bundle. The substantially parallel walls of the hood substantially prevent cross flow of refrigerant between the plurality of tubes of the upper tube bundle. A flow distributor is disposed adjacent the open end between the hood and the shell. The flow distributor modifies the refrigerant flow between the hood and the shell to provide a more uniform refrigerant flow distribution.

The present application yet further relates to a falling film evaporator for use in a control process including a shell having an upper portion and a lower portion. A tube bundle has a plurality of tubes extending substantially horizontally in the shell. A hood is disposed over the tube bundle, the hood having a closed end and an open end opposite the closed end, the closed end being disposed above the tube bundle adjacent the upper portion of the shell. The hood further has opposed substantially parallel walls extending toward the lower portion of the shell. A fluid distributor is disposed below the hood and above the tube bundle, the fluid distributor being configured to deposit liquid fluid or liquid and vapor fluid onto the tube bundle. The substantially parallel walls of the hood substantially prevent cross flow of the fluid between the plurality of tubes of the tube bundle. A flow distributor is disposed adjacent the open end between the hood and the shell. The flow distributor modifies the refrigerant flow between the hood and the shell to provide a more uniform refrigerant flow distribution.

The present application still further relates to an evaporator for use in a refrigeration system includes a shell and a tube bundle, the tube bundle having a plurality of tubes extending substantially horizontally in the shell. A hood is disposed over and laterally surrounds substantially all of the plurality of tubes of the tube bundle. A distributor is positioned between the hood and the tube bundle. The hood is asymmetrically disposed within the evaporator.

The present application yet further relates to an evaporator for use in a refrigeration system including a shell and a tube bundle, the tube bundle having a plurality of tubes extending substantially horizontally in the shell. A hood is disposed over and laterally surrounds substantially all of the plurality of tubes of the tube bundle. A distributor is positioned between the hood and the tube bundle. The hood includes surface textures.

An advantage of the present application is that it substantially prevents cross flow caused by expanding vaporizing fluid, facilitating increased heat transfer with a minimum re-circulation rate.

A still further advantage of the present application is that provides an efficient means of avoiding the carry-over of liquid droplets into the compressor suction.

A still further advantage of the present application is that it is easy to manufacture and install.

A still yet further advantage of the present application is that it can accommodate a mix of liquid and vapor at moderate or high pressure that is applied by the distributor over the tube bundle.

A further advantage of the present application is that it can be used with either a falling film evaporator construction or a hybrid falling film evaporator construction.

An additional advantage of the present application is that it can provide a more uniform flow distribution of refrigerant to achieve improved liquid separation.

Other features and advantages of the present application will be apparent from the following more detailed descriptions of embodiments, taken in conjunction with the accompanying drawings which illustrate, by way of example, the principles of the application. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present application. Also, common but well-understood elements that are useful or necessary in a commercially feasible embodiment are typically not depicted in order to facilitate a less obstructed view of these various embodiments of the present application.

Alternative exemplary embodiments relate to other features and combinations of features as may be generally recited in the claims.

BRIEF DESCRIPTION OF THE FIGURES

Wherever possible, the same reference numbers will be used throughout the drawings to refer to the same or like parts.

DETAILED DESCRIPTION OF THE EXEMPLARY EMBODIMENTS

Figure 1:
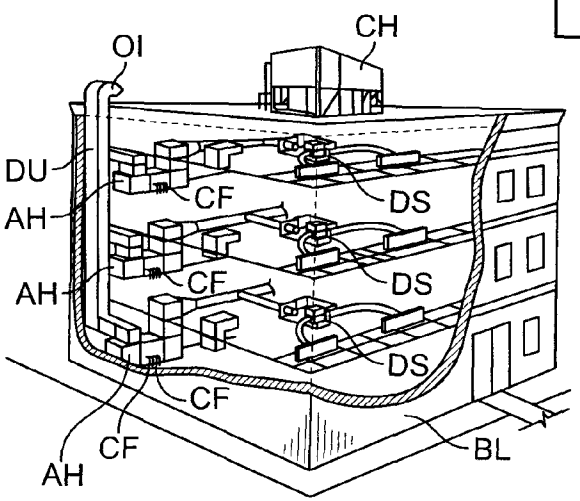
FIG. 1 is an illustration of an exemplary HVAC&R system disposed in a commercial setting.

FIG. 1 shows an exemplary HVAC&R system configured for providing cooling to a commercial building BL. A chiller system CH circulates a cooled fluid CF through coils disposed in air handling units AH. Air handling units AH use ducting DU to draw outside injested air OI that is mixed with recirculated air within building BL. The cooled fluid CF cools the mix of outside injested air OI and recirculated air that is provided throughout building BL by a distribution system DS to provide climate control within building BL. A boiler system (not shown) may be used to circulate a heated fluid for providing heating to the building BL.

Figure 2:
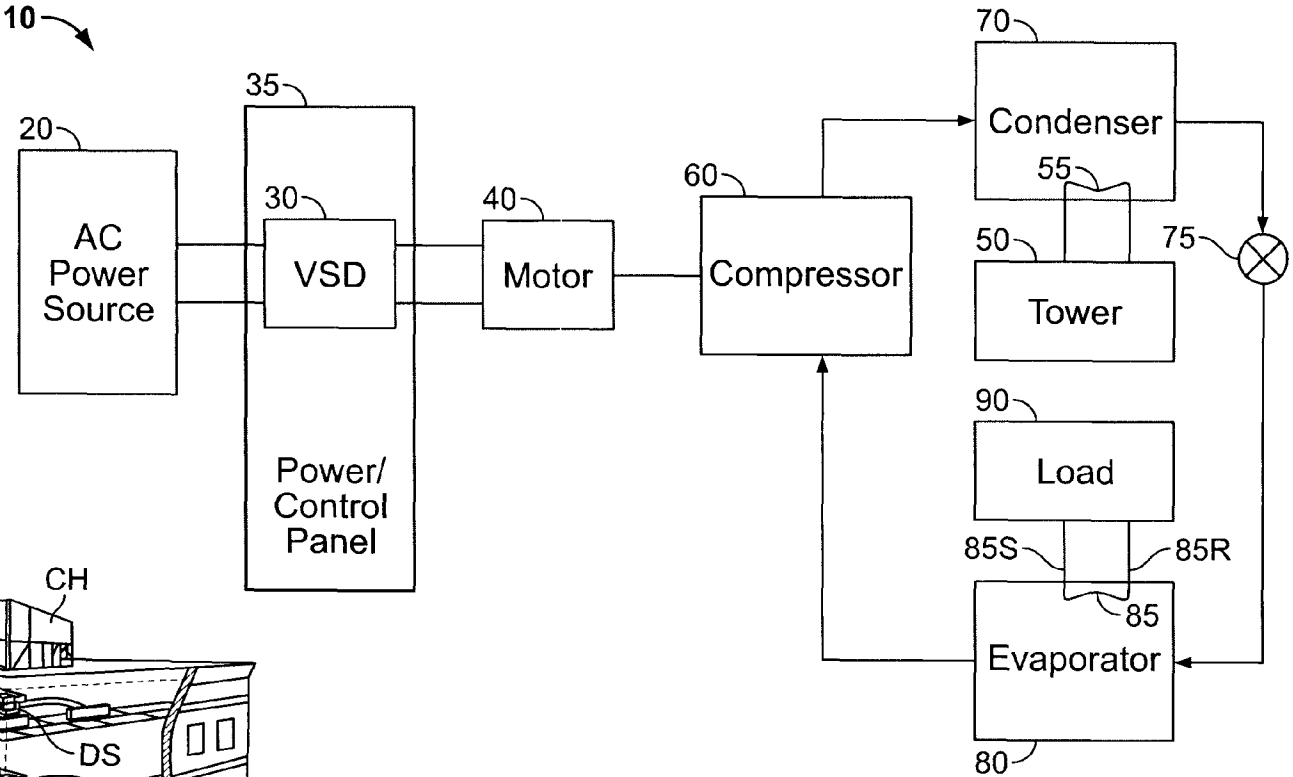
FIG. 2 is a schematic of a compressor system of the present application.

FIG. 2 illustrates generally one system configuration of the present application. A refrigeration or chiller system 10 includes an AC power source 20 that supplies a combination variable speed drive (VSD) 30 and power/control panel 35, which powers a motor 40 that drives a compressor 60, as controlled by the controls located within the power/control panel 35. It is appreciated that the term "refrigeration system" can include alternate constructions, such as a heat pump. In one embodiment of the application, all of the components of the VSD 30 are contained within the power/control panel 35. The AC power source 20 provides single phase or multi-phase (e.g., three phase), fixed voltage, and fixed frequency AC power to the VSD 30 from an AC power grid or distribution system that is present at a site. The compressor 60 compresses a refrigerant vapor and delivers the vapor to the condenser 70 through a discharge line. The compressor 60 can be any suitable type of compressor, e.g., centrifugal compressor, reciprocating compressor, screw compressor, scroll compressor, etc. The refrigerant vapor delivered by the compressor 60 to the condenser 70 enters into a heat exchange relationship with a fluid, such as water, flowing through a heat-exchanger coil or tube bundle 55 connected to a cooling tower 50. However, it is to be understood that condenser 70 can be air-cooled or can use any other condenser technology. The refrigerant vapor in the condenser 70 undergoes a phase change to a refrigerant liquid as a result of the heat exchange relationship with the liquid in the heat-exchanger coil 55. The condensed liquid refrigerant from condenser 70 flows to an expansion device 75, which greatly lowers the temperature and pressure of the refrigerant before entering the evaporator 80. Alternately, most of the expansion can occur in a nozzle 108 (FIGS. 3-8) when used as a pressure adjustment device. A fluid circulated in heat exchange relationship with the evaporator 80 can then provide cooling to an interior space.

The evaporator 80 can include a heat-exchanger coil 85 having a supply line 85S and a return line 85R connected to a cooling load 90. The heat-exchanger coil 85 can include a plurality of tube bundles within the evaporator 80. Water or any other suitable secondary refrigerant, e.g., ethylene, ethylene glycol, or calcium chloride brine, travels into the evaporator 80 via return line 85R and exits the evaporator 80 via supply line 85S. The liquid refrigerant in the evaporator 80 enters into a heat exchange relationship with the water in the heat-exchanger coil 85 to chill the temperature of the secondary refrigerant in the heat-exchanger coil 85. The refrigerant liquid in the evaporator 80 undergoes a phase change to a refrigerant vapor as a result of the heat exchange relationship with the liquid in the heat-exchanger coil 85. The vapor refrigerant in the evaporator 80 then returns to the compressor 60 to complete the cycle.

It is noted that the chiller system 10 of the present application may use a plurality of any combination of VSDs 30, motors 40, compressors 60, condensers 70, and evaporators 80.

Figure 4:
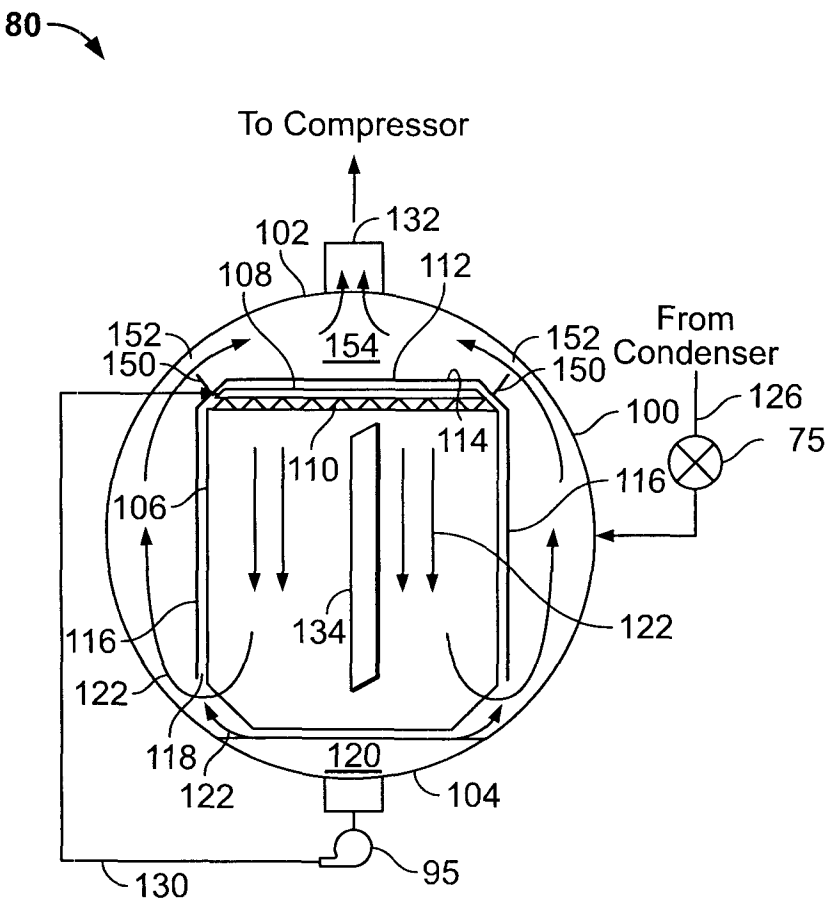
FIGS. 4-5 are cross sections of alternate embodiments of a falling film evaporator of the present application.
Figure 3:
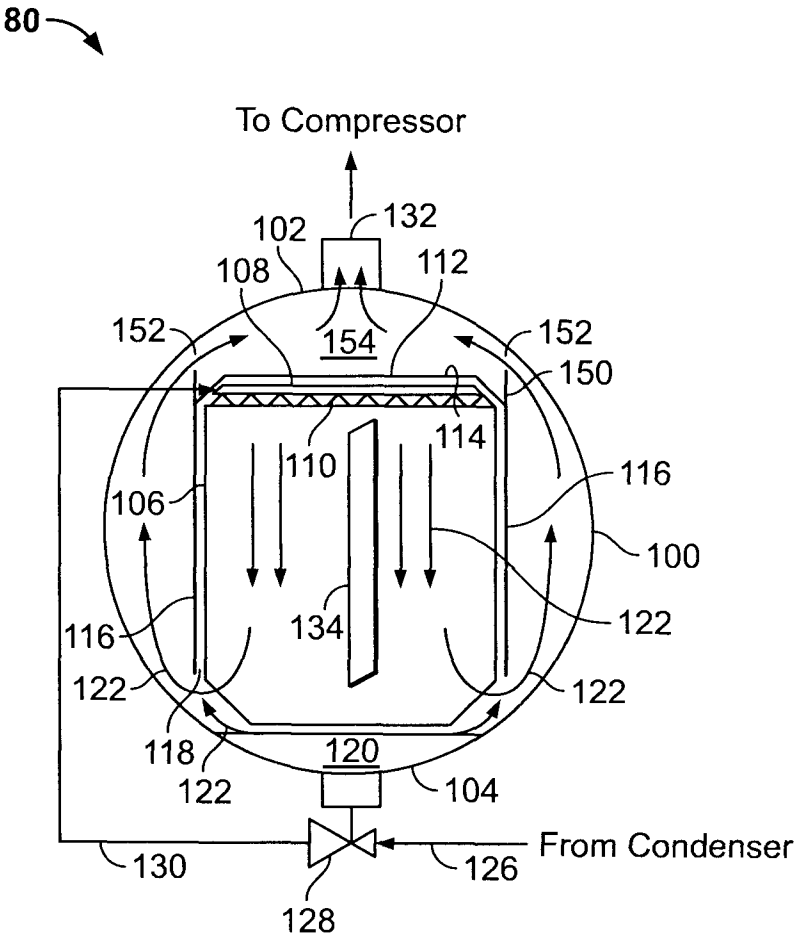
FIG. 3 is a cross section of an embodiment of a falling film evaporator of the present application.

Referring to FIG. 3, one embodiment of evaporator 80 is a falling film evaporator. In this embodiment, evaporator 80 includes a substantially cylindrical shell 100 having an upper portion 102 and a lower portion 104 with a plurality of tubes forming a tube bundle 106 extending substantially horizontally along the length of the shell 100. A suitable fluid, such as water, ethylene, ethylene glycol, or calcium chloride brine flows through the tubes of the tube bundle 106. A distributor 108 disposed above the tube bundle 106 distributes refrigerant fluid, such as R134a received from the condenser 126 that is in a liquid state or a two-phase liquid and vapor state, onto the upper tubes in the tube bundle 106. In other words, the refrigerant fluid can be in a two-phase state, i.e., liquid and vapor refrigerant. In FIG. 4, the refrigerant delivered to the distributor 108 is entirely liquid. In FIGS. 3, 5-7, the refrigerant delivered to the distributor 108 can be entirely liquid or a two-phase mixture of liquid and vapor. Liquid refrigerant that has been directed through the tubes of the tube bundle 106 without changing state collects adjacent the lower portion 104, this collected liquid refrigerant being designated as liquid refrigerant 120. Although a pump 95 can be used to re-circulate liquid refrigerant 120 from the lower portion 104 to the distributor 108 (FIGS. 4 and 5), an ejector 128 can be employed to draw the liquid refrigerant 120 from the lower portion 104 using the pressurized refrigerant from condenser 126, which operates by virtue of the Bernoulli effect, as shown in FIG. 3. In addition, while the level of the liquid refrigerant 120 is shown as being below the tube bundle 106 (e.g., FIGS. 3-5), it is to be understood that the level of the liquid refrigerant 120 may immerse a portion of the tubes of the tube bundle 106.

Further referring to FIG. 3, a hood 112 is disposed over the tube bundle 106 to substantially prevent cross flow of vapor refrigerant or of liquid and vapor refrigerant between the tubes of the tube bundle 106. The hood 112 includes an upper end 114 adjacent the upper portion 102 of the shell 100 above the tube bundle 106 and above the distributor 108. Extending from opposite ends of the upper end 114 toward the lower portion 104 of the shell 100 are opposed substantially parallel walls 116, in one embodiment the walls 116 extending substantially vertically and terminating at an open end 118 that is substantially opposite the upper end 114. In one embodiment, the upper end 114 and parallel walls 116 are closely disposed adjacent to the tubes of the tube bundle 106, with the parallel walls 116 extending sufficiently toward the lower portion 104 of the shell 100 as to substantially laterally surround the tubes of the tube bundle 106. However, it is not required that the parallel walls 116 extend vertically past the lower tubes of the tube bundle 106, nor is it required that the parallel walls 116 are planar, although vapor refrigerant 122 that forms within the outline of the tube bundle 106 is channeled substantially vertically within the confines of the parallel walls 116 and through the open end 118 of the hood 112. The hood 112 forces the vapor refrigerant 122 downward between the walls 116 and through the open end 118, then upward in the space between the shell 100 and the walls 116 from the lower portion 104 of the shell 100 to the upper portion 102 of the shell 100. The vapor refrigerant 122 then flows over a pair of extensions 150 protruding adjacent to the upper end 114 of the parallel walls 116 and into a suction channel 154. The vapor refrigerant 122 enters into the suction channel 154 through slots 152 which are spaces between the ends of the extensions 150 and the shell 100 that define slots 152, before exiting the evaporator 80 at an outlet 132 that is connected to the compressor 60.

Refrigerant 126 that is received from the condenser 70 and the lower portion 104 of the shell 100 (liquid refrigerant 120) is directed through the distributor 108 and, as shown, deposited from a plurality of positions 110 onto the upper tubes of the tube bundle 106. These positions 110 can include any combination of longitudinal or lateral positions with respect to the tube bundle 106. In one embodiment, distributor 108 includes a plurality of nozzles supplied at least by a liquid ramp that is supplied by the condenser 70. The nozzles apply, in one embodiment, a predetermined jet pattern so that the upper row of tubes are covered. An amount of the refrigerant boils by virtue of the heat exchange that occurs along the tube surfaces of the tube bundle 106. This expanding vapor refrigerant 122 is directed downwardly toward the open end 118 since the upper end 114 of the hood 112 and substantially parallel walls 116 provide no alternate escape path. Since, as shown, the substantially parallel walls 116 are adjacent to the outer column of tubes of the tube bundle 106, vapor refrigerant 122 is forced substantially vertically downward, substantially preventing the possibility of cross flow of the vapor refrigerant 122 inside the hood 112. The tubes of the tube bundle 106 are arranged to promote the flow of refrigerant in the form of a film around the tube surfaces, the liquid refrigerant coalescing to form droplets or, in some instances, a curtain or sheet of liquid refrigerant at the bottom of the tube surfaces. The resulting sheeting promotes wetting of the tube surfaces which enhances the heat transfer efficiency between the fluid flowing inside the tubes of the tube bundle 106 and the refrigerant flowing around the surfaces of the tubes of the tube bundle 106.

Unlike current systems, the upper end 114 of the hood 112 substantially prevents the flow of applied refrigerant 110, in the form of vapor and mist, at the top of the tube bundle 106 from flowing directly to the outlet 132 which is fed to the compressor 60. Instead, by directing the refrigerant 122 to have a downwardly directed flow, the vapor refrigerant 122 must travel downward through the length of the substantially parallel walls 116 before the refrigerant can pass through the open end 118. After the vapor refrigerant 122 passes the open end 118 which contains an abrupt change in direction, the vapor refrigerant 122 is forced to travel between the hood 112 and the inner surface of the shell 100. This abrupt directional change results in a great proportion of any entrained droplets of refrigerant to collide with either the liquid refrigerant 120 or the shell 100 or hood 112, removing those droplets from the vapor refrigerant 122 flow. Also, refrigerant mist traveling the length of the substantially parallel walls 116 is coalesced into larger drops that are more easily separated by gravity, or evaporated by heat transfer on the tube bundle 106.

Once the vapor refrigerant 122 passes through the parallel walls 116 of the hood 112, the vapor refrigerant 122 then flows from the lower portion 104 to the upper portion 102 along the prescribed narrow passageway, and, as shown, substantially symmetric passageways, formed between the surfaces of the hood 112 and the shell 100 prior to reaching the outlet 132. As a result of the increased drop size, the efficiency of liquid separation by gravity is improved, permitting an increased upward velocity of vapor refrigerant 122 flow through the evaporator. A baffle is provided adjacent the evaporator outlet to prevent a direct path of the vapor refrigerant 122 to the compressor inlet. The baffle includes slots 152 defined by the spacing between the ends of extensions 150 and the shell 100. The combination of the substantially parallel walls 116, narrow passageways and slots 152 in the evaporator 80 removes virtually all the remaining entrained droplets from the vaporized refrigerant 122.

By substantially eliminating cross flow of vapor refrigerant and coalesced drops of liquid refrigerant along tube bundle 106, the amount of refrigerant 120 that must be recirculated can be reduced. It is the reduction of the amount of recirculated refrigerant flow that can enable the use of ejector 128, versus a conventional pump. The ejector 128 combines the functions of an expansion device and a refrigerant pump. In addition, it is possible to incorporate all expansion functionality into the distributor 108 nozzles. In one embodiment, two expansion devices are employed: a first expansion device being incorporated into spraying nozzles of the distributor 108. A second expansion device can also be a partial expansion in the liquid line 130, such as a fixed orifice, or alternately, a valve controlled by the level of liquid refrigerant 120, to account for variations in operating conditions, such as evaporating and condensing pressures, as well as partial cooling loads. Further, in one embodiment, most of the expansion occurs in the nozzles, providing a greater pressure difference, while simultaneously permitting the nozzles to be of reduced size, thereby reducing the size and cost of the nozzles.

Figure 6:
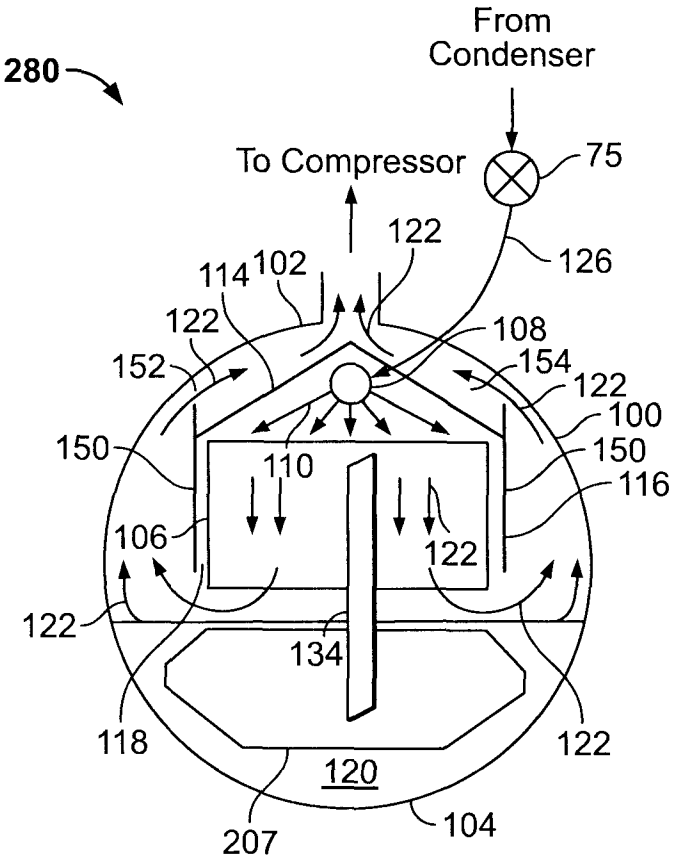
FIG. 6 is a cross section of an embodiment of a hybrid falling film evaporator of the present application.
Figure 5:
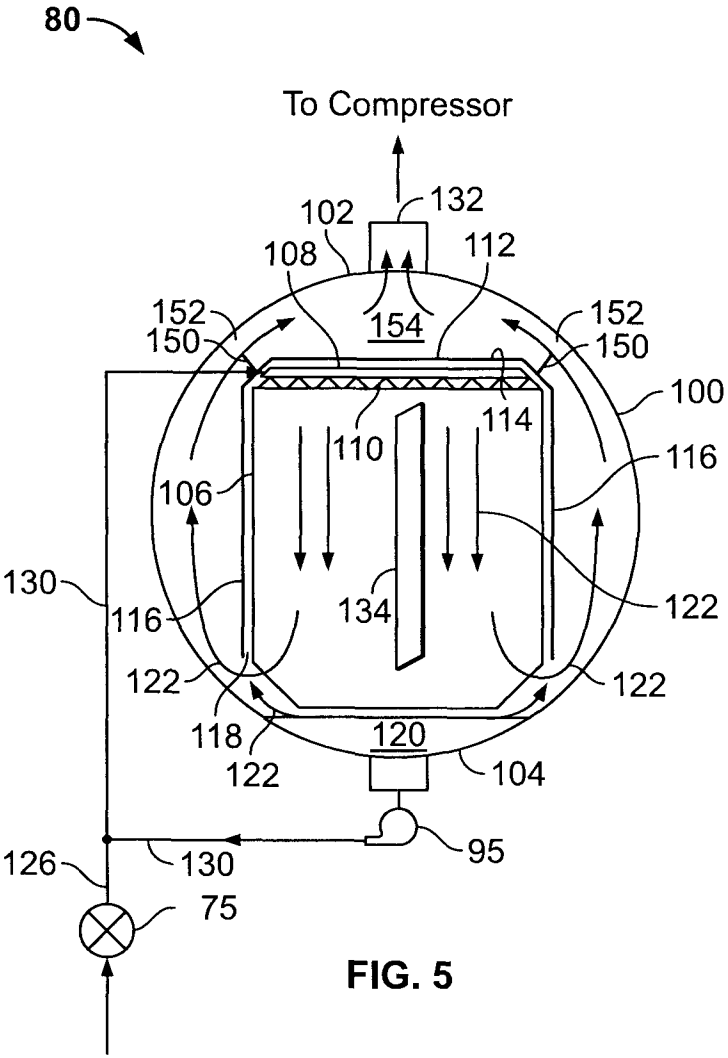

Referring to FIG. 6, an embodiment of a hybrid falling film evaporator 280 is presented which includes an immersed or at least partially immersed tube bundle 207 in addition to a tube bundle 106. Except as discussed, corresponding components in evaporator 280 are otherwise similar to evaporator 80. In one embodiment, evaporator 280 incorporates a two pass system in which fluid that is to be cooled first flows inside the tubes of lower tube bundle 207 and then is directed to flow inside the tubes of the upper tube bundle 106. Since the second pass of the two pass system occurs on the top tube bundle 106, the temperature of the fluid flowing in the tube bundle 106 is reduced, requiring a lesser amount of refrigerant flow over the surfaces of the tube bundle 106. Thus, there is no need to re-circulate refrigerant 120 to the distributor 108. Also, the bundle 207 evaporates the extra refrigerant dropping from tube bundle 106. If there is no recirculation device, e.g., pump or ejector, the falling film evaporator must be a hybrid.

It is to be understood that although a two pass system is described in which the first pass is associated with an at least partially immersed (flooded) lower tube bundle 207 and the second pass associated with upper tube bundle 106 (falling film), other arrangements are contemplated. For example, the evaporator can incorporate a one pass system with any percentage of flooding associated with lower tube bundle 207, the remaining portion of the one pass associated with upper tube bundle 106. Alternately, the evaporator can incorporate a three pass system in which two passes are associated with lower tube bundle 207 and the remaining pass associated with upper tube bundle 106, or in which one pass is associated with lower tube bundle 207 and its remaining two passes are associated with upper tube bundle 106. Further, the evaporator can incorporate a two pass system in which one pass is associated with upper tube portion 106 and the second pass is associated with both the upper tube portion 106 and the lower tube portion 207. In summary, any number of passes in which each pass can be associated with one or both of the upper tube bundle and the lower tube bundle is contemplated.

While embodiments have been directed to refrigeration systems, the evaporator of the present application can also be used with process systems, such as a chemical process involving a blend of two components, one being volatile such as in the petrochemical industry. Alternately, the process system could relate to the food processing industry. For example, the evaporator of the present application could be used to control a juice concentration. Referring to FIG. 3, a juice (e.g., orange juice) fed through the fluid distributor 108 is heated, a portion becoming vapor, while the liquid 120 accumulating at the lower portion of the evaporator contains a higher concentration of juice. One skilled in the art can appreciate that the evaporator can be used for other process systems.

In one embodiment, the walls 116 are parallel and the walls 116 are symmetric about a central vertical plane 134 bisecting the upper and lower portions 102, 104, since the tube bundle 106 arrangements are typically similarly symmetric.

The arrangement of tubes in tube bundles 106 is not shown, although a typical arrangement is defined by a plurality of uniformly spaced tubes that are aligned vertically and horizontally, forming an outline that can be substantially rectangular. However, a stacking arrangement wherein the tubes are neither vertically or horizontally aligned may also be used, as well as arrangements that are not uniformly spaced.

In addition or in combination with other features of the present application, different tube bundle constructions are contemplated. For example, it is possible to reduce the volume of the shell 100 if the refrigerant is deposited by the distributor 108 at wide angles. However, such wide angles can create deposited refrigerant having horizontal velocity components, possibly generating an uneven longitudinal liquid distribution. To address this issue, finned tubes (not shown), as are known in the art, can be used along the uppermost horizontal row or uppermost portion of the tube bundle 106. Besides possibly using finned tubes on top, the straightforward approach is to use new generation enhanced tube developed for pool boiling in flooded evaporators. Additionally, or in combination with the finned tubes, porous coatings, as are known in the art, can also be applied to the outer surface of the tubes of the tube bundles 106.

Figure 8:
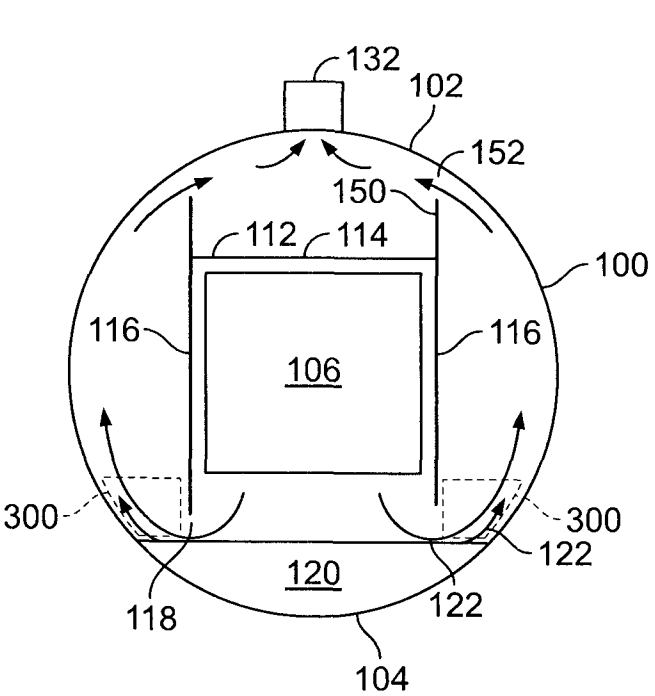
FIG. 8 is a cross section of a flow distribution device for an evaporator of the present application.

Referring to FIG. 8, which is generic to both evaporator constructions of the present application, a hood 112 has substantially vertical walls 116 that substantially prevents cross flow caused by expanding vaporizing refrigerant fluid 122, facilitating increased heat transfer with a minimum re-circulation rate. In addition, as previously discussed, the vapor refrigerant 122, passes through the parallel walls 116 of the hood 112 and then flows from the lower portion 104 to the upper portion 102 along the prescribed narrow passageway formed between the surfaces of the hood 112 and the shell 100 prior to reaching the outlet 132. As a result of the increased drop size, the efficiency of liquid separation by gravity is improved, permitting an increased upward velocity of vapor refrigerant 122 flow through the evaporator. A baffle is provided adjacent the evaporator outlet to prevent a direct path of the vapor refrigerant 122 to the compressor inlet. The baffle includes slots 152 defined by the spacing between the ends of extensions 150 and the shell 100. The combination of the substantially parallel walls 116, narrow passageways and slots 152 in the evaporator 80 removes virtually all the remaining entrained droplets from the vaporized refrigerant 122.

To further improve the efficiency of liquid separation, as shown in FIG. 8, a flow distributor 300 is disposed adjacent to the open end 118 between hood 112 and shell 100. Flow distributor 300 modifies the refrigerant flow between hood 112 and the shell 100 to provide a more uniform refrigerant flow distribution. Due to the more uniform refrigerant flow distribution, the velocity of vapor refrigerant 122 is reduced, improving the efficiency of liquid separation by gravity.

Figure 9:
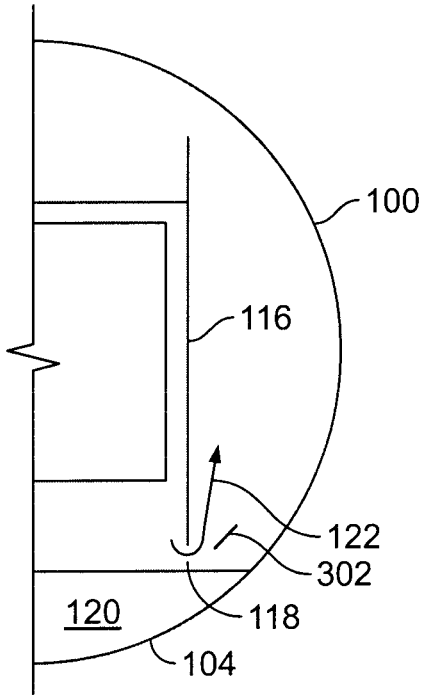
FIGS. 9-12 is a cross section of various embodiments of flow distribution devices for an evaporator of the present application.
Figure 10:
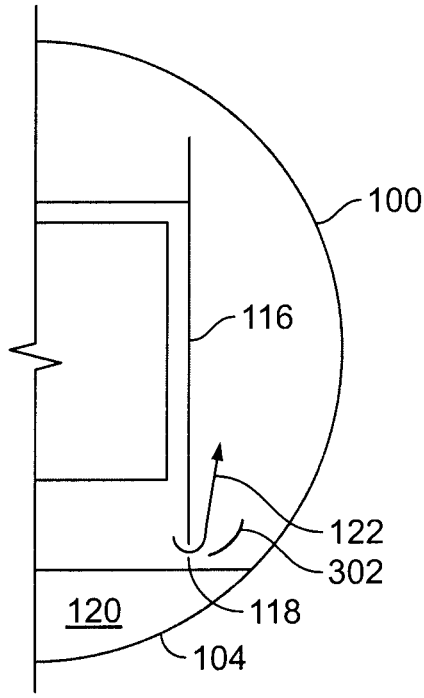

Referring to FIGS. 9-12, several embodiments of flow distributors are discussed. For example, as shown in FIG. 9, flow distributor 302 is in the form of a guide vane that is angled with respect to wall 116. As shown in FIG. 10, guide vane 302 has a curved profile. Although the flow distributors 302 are shown disposed between wall 116 and lower portion 104 of shell 100, it is to be understood that the flow distributors can extend from either wall 116 or the shell or from both. Further, through apertures can be formed in flow distributors 302.

Figure 11:
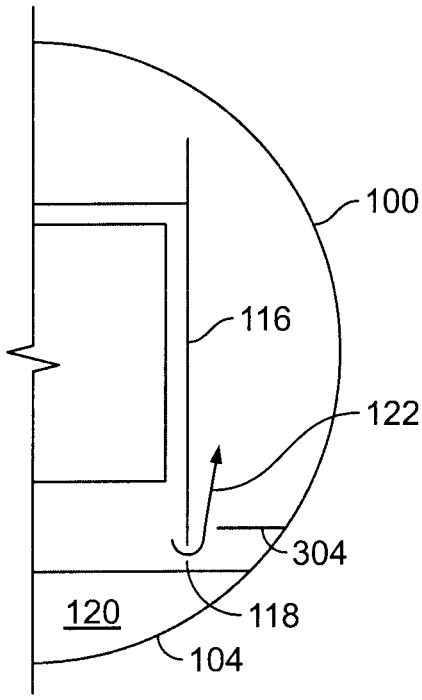
Figure 12:
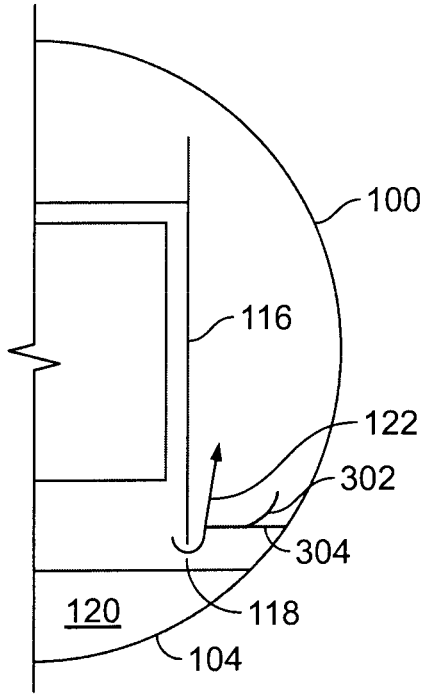

Referring to FIG. 11, flow distributor 304 is a plate extending toward wall 116 and disposed substantially perpendicular to wall 116, and containing a plurality of through apertures. In one embodiment, flow distributor 302 includes apertures of different sizes, with smaller through apertures being disposed on portions of the flow distributor that is adjacent to shell 100. In another embodiment, flow distributor 302 is a wire mesh. Referring to FIG. 12, flow distributor 302 includes a combination of a guide vane and a plate 304.

It is to be understood that embodiments of flow distributors can include any combination of elements disposed anywhere along the lower portion 104 of shell, such as between wall 116 and shell 100 that act to improve liquid separation of the refrigerant flow 122 and provide more uniform flow velocities by redirecting the flow of refrigerant. In addition, flow distributors can exhibit porosity, for example, non-woven wire mesh or an alternate structural arrangement, such as honeycomb.

It is also understood that the various embodiments of flow distributor can also be used with applications outside of refrigeration systems, as previously discussed.

Figure 13:
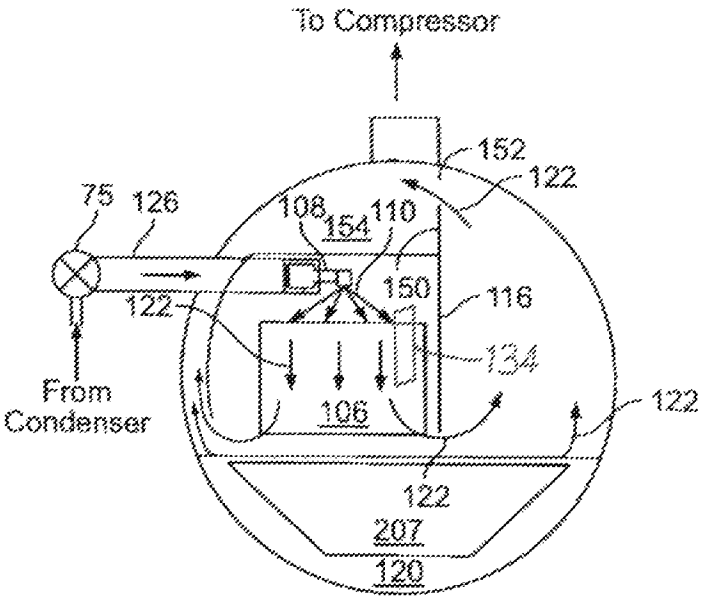
FIG. 13 is a cross section of a further embodiment of a hybrid falling film evaporator of the present application.

In another embodiment (FIG. 13) the hood is asymmetrically disposed within the evaporator relative to central vertical plane 134 which bisects the shell as previously discussed and shown in FIGS. 3-6, with more than one half of the flow of refrigerant flowing beneath the one side disposed further from the shell. As shown, substantially all of the refrigerant flowing is beneath one side of the hood.

Figure 7:
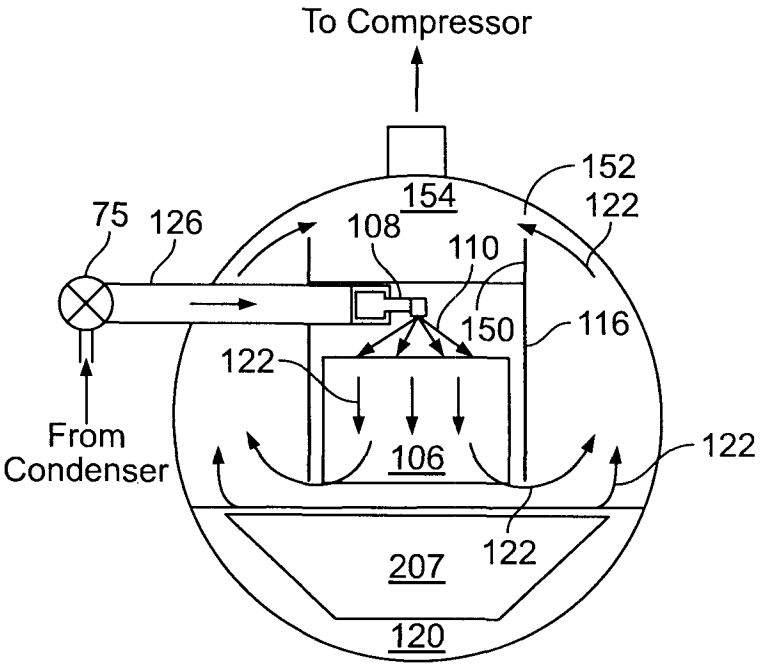
FIG. 7 is a cross section of a further embodiment of a hybrid falling film evaporator of the present application.
Figure 14:
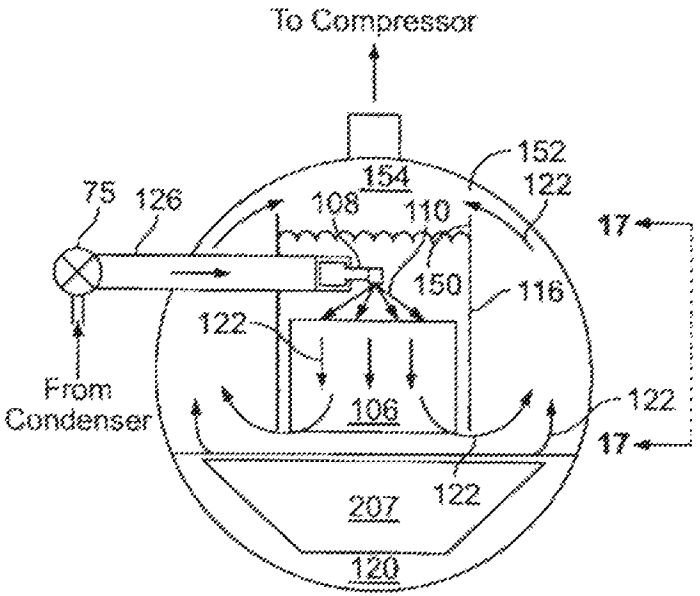
FIG. 14 is a cross section of a further embodiment of a hybrid falling film evaporator of the present application.
Figure 15:
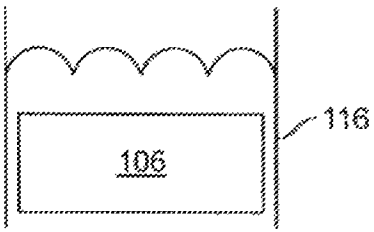
FIG. 15 is an elevation view of an embodiment of a hood taken along line 17-17 of FIG. 14.

Surface textures can be advantageous for the hood, i.e., smooth versus pitted or scuffed surfaces. The shape and structure of the roof top of the hood can be important for the following reasons: 1) it is desired that the distribution of liquid over the tubes be as uniform as possible; 2) the spray nozzles and impact on the tubes generate some mist that will strike the roof. From there, the liquid may fall back in a totally uncontrolled way. For instance, as shown in FIG. 6, the liquid that reaches the roof of the hood is likely due to capillary action, then reach the vertical walls of the hood and fall to the bottom part of the hood without contributing to wetting the walls of the bundle 106. FIG. 7 would produce liquid droplets to fall in an arrangement still far from uniform, but must be better than FIG. 6, because the liquid will at least drip upon the outer columns of tubes, and will not be lost. More sophisticated designs are possible, such as a substantially horizontal roof having multiple ripples (FIG. 14) dripping above each column of tubes to bundle 106, although other arrangements are possible. For example, in an alternate embodiment as shown in FIG. 15, taken along line 17-17 of FIG. 14, ripples or surface discontinuities sufficient to distribute liquid refrigerant from the roof of the hood can extend substantially transverse to the direction of the tubes of tube bundle 106. Alternatively, the ripples or surface discontinuities can extend at an angle to the direction of the tubes of tube bundle 106. However, it is appreciated that the ripples or discontinuities can be non-linear and non-uniform in profile. In addition, the roof of the hood can have coatings of material applied to the surface to achieve the desired flow of liquid refrigerant or in combination with shaped profiles of the roof of the hood. The vapor refrigerant 122 then flows over a pair of extensions 150 protruding adjacent to the upper end 114 of the parallel walls 116 and into a suction channel 154. The vapor refrigerant 122 enters into the suction channel 154 through slots 152 which are spaces between the ends of the extensions 150 and the shell 100 that define slots 152, before exiting the evaporator 80 at an outlet 132 that is connected to the compressor 60.

Unlike current systems, the upper end 114 of the hood 112 substantially prevents the flow of applied refrigerant 110, in the form of vapor and mist, at the top of the tube bundle 106 from flowing directly to the outlet 132, which is fed to the compressor 60. Instead, by directing the refrigerant 122 to have a downwardly directed flow, the vapor refrigerant 122 must travel downward through the length of the substantially parallel walls 116 before the refrigerant can pass through the open end 118. After the vapor refrigerant 122 passes the open end 118, which contains an abrupt change in direction, the vapor refrigerant 122 is forced to travel between the hood 112 and the inner surface of the shell 100. This abrupt directional change results in a great proportion of any entrained droplets of refrigerant to collide with either the liquid refrigerant 120 or the shell 100 or hood 112, removing those droplets from the vapor refrigerant 122 flow. Also, refrigerant mist traveling the length of the substantially parallel walls 116 is coalesced into larger drops that are more easily separated by gravity, or evaporated by heat transfer on the tube bundle 106.

It is to be understood that although a two pass system is described in which the first pass is associated with an at least partially immersed (flooded) lower tube bundle 207 and the second pass associated with upper tube bundle 106 (falling film), other arrangements are contemplated. For example, the evaporator can incorporate a one pass system with any percentage of flooding associated with lower tube bundle 207, the remaining portion of the one pass associated with upper tube bundle 106. Alternately, the evaporator can incorporate a three pass system in which two passes are associated with lower tube bundle 207 and the remaining pass associated with upper tube bundle 106, or in which one pass is associated with lower tube bundle 207 and its remaining two passes are associated with upper tube bundle 106. Further, the evaporator can incorporate a two pass system in which one pass is associated with upper tube portion 106 and the second pass is associated with both the upper tube portion 106 and the lower tube portion 207. In summary, any number of passes in which each pass can be associated with one or both of the upper tube bundle and the lower tube bundle is contemplated.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the evaporator as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

What is claimed is:

1. An evaporator for use in a refrigeration system comprising:

a shell;

a tube bundle, the tube bundle having a plurality of tubes extending substantially horizontally in the shell;

a hood disposed over and laterally surrounding substantially all of the plurality of tubes of the tube bundle;

a distributor positioned between the hood and the tube bundle; and wherein the hood is asymmetrically disposed relative to a vertical plane bisecting the shell.

2. The evaporator of claim 1, wherein at least a portion of the hood is in close proximity with the shell.

3. The evaporator of claim 2, wherein the portion of the hood in close proximity with the shell is substantially parallel with the shell.

* * * * *